US008893536B2

(12) United States Patent
Huang et al.

(10) Patent No.: US 8,893,536 B2
(45) Date of Patent: Nov. 25, 2014

(54) REKEYABLE LOCK CYLINDER

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 848 days.

(21) Appl. No.: 12/651,271

(22) Filed: Dec. 31, 2009

(65) Prior Publication Data

US 2011/0154872 A1 Jun. 30, 2011

(51) Int. Cl.

| | |
|---|---|
| ***E05B 29/04*** | (2006.01) |
| ***E05B 27/04*** | (2006.01) |
| ***E05B 27/00*** | (2006.01) |
| ***E05B 29/00*** | (2006.01) |

(52) U.S. Cl.

CPC ..... *E05B 27/005* (2013.01); *E05B 29/004* (2013.01)

USPC ..... 70/383; 70/340; 70/384; 70/492

(58) Field of Classification Search

USPC ..... 70/337–343, 368, 382–385, 492–493, 70/495

See application file for complete search history.

(56) References Cited

U.S. PATENT DOCUMENTS

| | | | | |
|---|---|---|---|---|
| 6,860,131 | B2 | 3/2005 | Armstrong | |
| 7,007,528 | B2 * | 3/2006 | Chong et al. | 70/492 |
| 7,424,815 | B1 * | 9/2008 | Pagnoncelli | 70/340 |
| 7,448,239 | B1 * | 11/2008 | Huang et al. | 70/360 |
| 7,448,240 | B1 * | 11/2008 | Huang et al. | 70/492 |
| 7,526,935 | B2 * | 5/2009 | Huang et al. | 70/360 |
| 7,624,606 | B1 * | 12/2009 | Huang et al. | 70/338 |
| 7,628,048 | B2 * | 12/2009 | Huang et al. | 70/338 |
| 7,836,739 | B2 * | 11/2010 | Huang et al. | 70/360 |
| 7,980,104 | B1 * | 7/2011 | Huang | 70/338 |
| 7,980,106 | B2 * | 7/2011 | Huang et al. | 70/383 |
| 2005/0217330 | A1 * | 10/2005 | Chong et al. | 70/492 |
| 2008/0276674 | A1 * | 11/2008 | Huang et al. | 70/493 |
| 2009/0277240 | A1 | 11/2009 | Huang | |

* cited by examiner

*Primary Examiner* — Christopher Boswell

(74) *Attorney, Agent, or Firm* — Muncy, Gesissler, Olds & Lowe, P.C.

(57) ABSTRACT

A rekeyable lock cylinder comprises a cylinder body, a plug assembly disposed within the cylinder body and an operation error preventing unit. The cylinder body has a plurality of upper pin holes and an accommodating hole. The plug assembly comprises a plug body, a plurality of assembled rack components and a position block disposed within the plug body. The plug body has an outside wall, a keyhole, a plurality of lower pin holes and a first hole in communication with the outside wall and the keyhole. The assembled rack components are disposed at each of the lower pin holes of the plug body respectively. The operation error preventing unit comprises a first movable member disposed at the accommodating hole of the cylinder body and a second movable member disposed at the first hole of the plug body, and the first movable member may contact against the second movable member.

17 Claims, 12 Drawing Sheets

REKEYABLE LOCK CYLINDER

FIELD OF THE INVENTION

The present invention is generally relating to a rekeyable lock cylinder, more particularly to a rekeyable lock cylinder.

BACKGROUND OF THE INVENTION

The known rekeyable lock cylinder, such as disclosed in U.S. Pat. No. 6,860,131 and No. 20090277240, requires that a new authorized key must be pushed into the position (i.e. completely pushed-in) before turning during rekeying process. However, the user generally turns a new authorized key without pushing in it at the position for the known rekeyable lock cylinder structure when rekeying, which has not completed entire rekeying process resulting in that even the next user pushes a new authorized key in at the position (i.e. completely pushed-in), the lock cylinder cannot be unlocked normally. Therefore, how to assure the user pushes a new authorized key in at the position (i.e. completely pushed-in) before performing rekeying operation is an extremely important topic toward the structural design of rekeyable lock cylinder.

SUMMARY

A primary object of the present invention is to provide a fool-proofing rekeying lock cylinder comprising a cylinder body, a plug assembly disposed within the cylinder body and an operation error preventing unit. The cylinder body has a plurality of upper pin holes and an accommodating hole, the plug assembly comprises a plug body, a plurality of assembled rack components and a position block disposed within the plug body. The plug body has a longitudinal direction, an outside wall, a keyhole, a plurality of lower pin holes and a first hole in communication with the outside wall and the keyhole. The assembled rack components are disposed at each of the lower pin holes of the plug body respectively. The operation error preventing unit comprises a first movable member disposed at the accommodating hole of the cylinder body and a second movable member disposed in the first hole of the plug body, wherein the first movable member is perpendicular to the longitudinal direction, and the second movable member is inclined at an angle to the first movable member when the lock cylinder is locked. When the plug assembly turns to a rekeyable position, the first movable member moves into the first hole and contacts against the second movable member where the first movable member is aligned with the second movable member so as to limit rotation of the plug assembly opposite to the cylinder body. According to the present invention, the operation error preventing unit can certainly assure rekeying operation is performed only under the condition that the key is inserted into the position so fool-proofing efficiency can be reached.

DETAILED DESCRIPTION OF THE INVENTION

Figure 1:
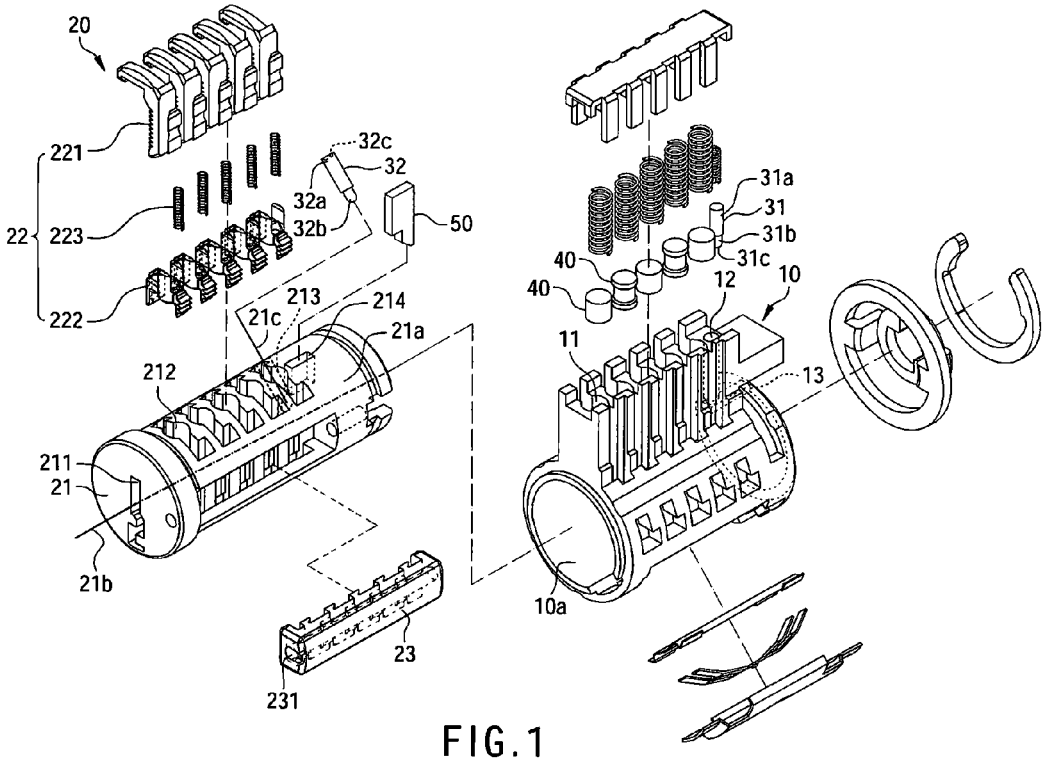
FIG. 1 is a perspective exploded view illustrating a rekeyable lock cylinder in accordance with a preferred embodiment of the present invention.
Figure 2:
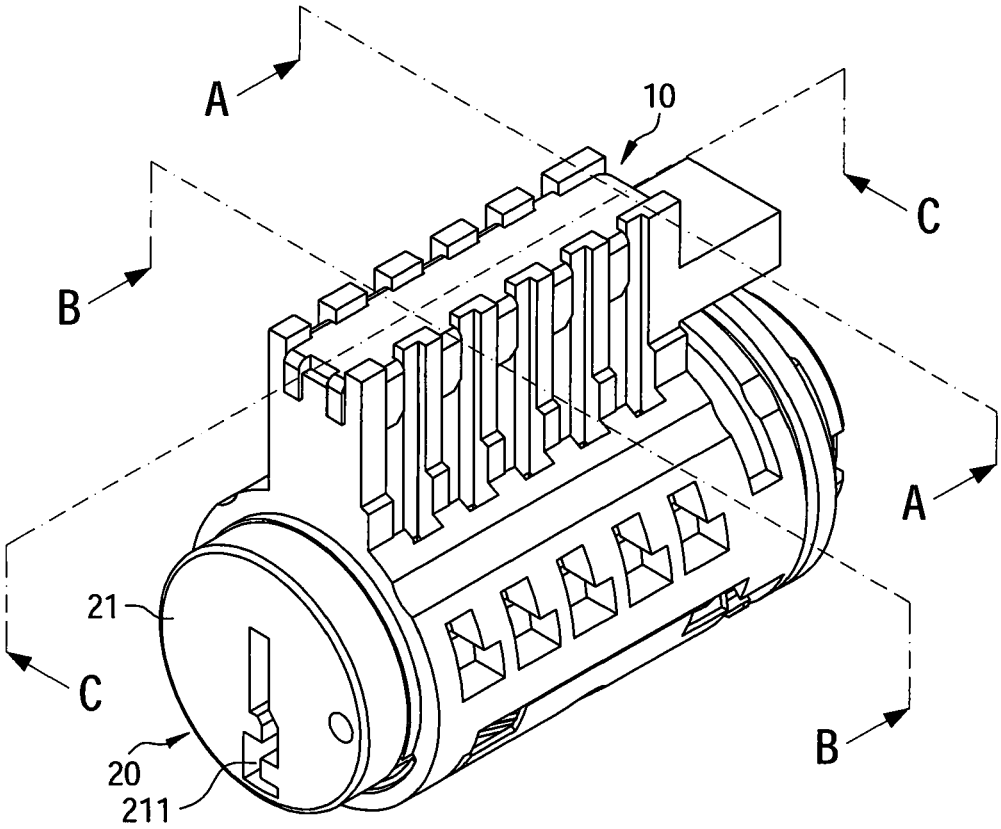
FIG. 2 is a perspective assembly view illustrating the rekeyable lock cylinder.
Figure 3:
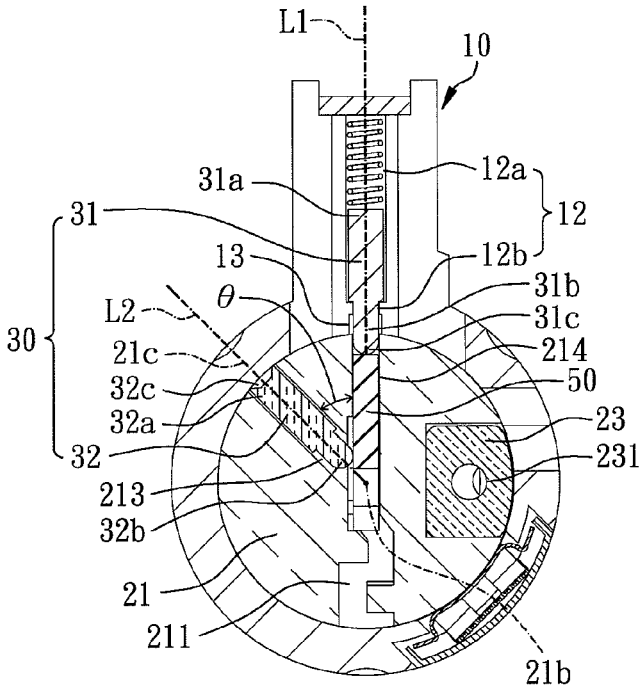
FIG. 3 is an assembled longitudinal section view illustrating the rekeyable lock cylinder along A-A line of FIG. 2.
Figure 4:
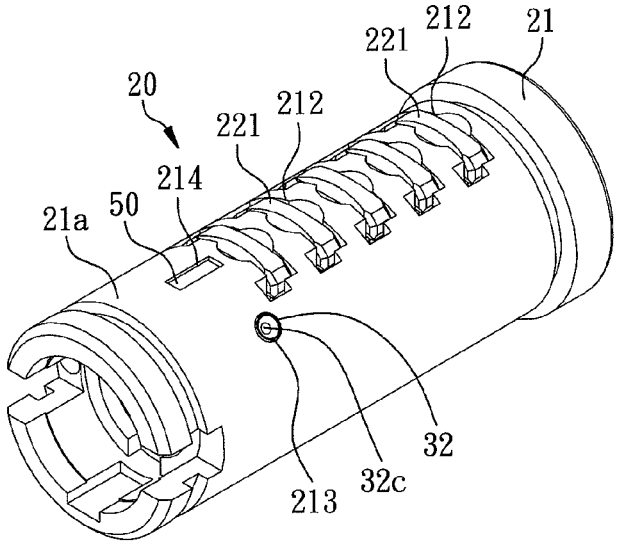
FIG. 4 is a perspective assembly view illustrating a plug assembly in accordance with a preferred embodiment of the present invention.

With reference to FIGS. 1, 2 and 3, a rekeyable lock cylinder in accordance with a preferred embodiment of the present invention comprises a cylinder body 10, a plug assembly 20 rotatable disposed within the cylinder body 10, an operation error preventing unit 30 and a plurality of upper pins 40. The cylinder body 10 has an inside wall 10*a*, a plurality of upper pin holes 11, an accommodating hole 12 and a limiting slot 13 recessed from the inside wall 10*a*. The upper pin holes 11 act for accommodating the upper pins 40, the accommodating hole 12 has an upper slot portion 12*a* and a lower slot portion 12*b*, in which an inner diameter of the upper slot portion 12*a* is smaller than that of each upper pin hole 11, an inner diameter of the lower slot portion 12*b* is smaller than that of the upper slot portion 12*a*. Besides, the limiting slot 13 communicates with the lower slot portion 12*b* of the accommodating hole 12. With reference to FIGS. 1, 3 and 4, the plug assembly 20 comprises a plug body 21, a plurality of assembled rack components 22 and a position block 23 disposed within the plug body 21. The plug body 21 has an outside wall 21*a*, a longitudinal direction 21*b* defined thereon, a transverse direction 21*c* defined thereon and perpendicular to the longitudinal direction 21*b*, a keyhole 211 formed along the longitudinal direction 21*b*, a plurality of lower pin holes 212, a first hole 213 in communication with the outside wall 21*a* and the keyhole 211, and a second hole 214 in communication with the outside wall 21*a* and the keyhole 211, and further the first hole 213 is located adjacent to the longitudinal direction 21*b*, preferably the first hole 213 is formed along the transverse direction 21*c*. Within this embodiment, there is an included angle θ between the second hole 214 and the first hole 213, the second hole 214 corresponds to the limiting slot 13 of the cylinder body 10. With reference again to FIGS. 1 and 4, the assembled rack components 22 are disposed at each of the lower pin holes 212 of the plug body 21 respectively, in which the assembled rack components 22 are height-adjustable pins and each of them comprises a first rack component 221, a second rack component 222 in engagement with the first rack component 221 and an elastic component 223 disposed between the first and second rack components 221, 222. The position block 23 has a rekeying tool opening 231 for disposing a rekeying tool (not shown in the drawing). Furthermore, with reference again to FIGS. 1, 3 and 4, the plug assembly 20 according to the present invention may further comprise a burglarproof member 50 disposed at the second hole 214 of the plug body 21 in order to improve burglarproof and security of lock cylinder. When lock cylinder is picked by a burglar with a picklock component, the burglarproof member 50 will move to the limiting slot 13 of the cylinder body 10 to limit rotation of the plug assembly 20.

With reference again to FIGS. 1 and 3, the operation error preventing unit 30 comprises a first movable member 31 and a second movable member 32, wherein the first movable member 31 is perpendicular to the longitudinal direction 21*b*, and the second movable member 32 is inclined at an angle to the first movable member 31 when the lock cylinder is locked. The first movable member 31 disposed at the accommodating hole 12 of the cylinder body 10 has an upper rod portion 31*a* located at the upper slot portion 12*a* of the accommodating hole 12, a lower rod portion 31*b* capable of being located at the lower slot portion 12*b* of the accommodating hole 12 and the limiting slot 13 and an end 31*c*, in which a diameter of the upper rod portion 31*a* is larger than that of the lower rod portion 31*b*. Preferably, the first movable member 31 further comprises an axial line L1 perpendicular to the longitudinal direction 21*b*. The second movable member 32 is disposed at the first hole 213 of the plug body 21 and has a first side 32*a*, a second side 32*b* opposite to the first side 32*a*, a position slot 32*c* recessed at the first side 32*a* and an offset line L2 which is inclined at an angle to the axial line L1 when the lock cylinder is locked. The second side 32*b* of the second movable member 32 should contact against the burglarproof member 50 in normal operation condition.

Figure 5A:
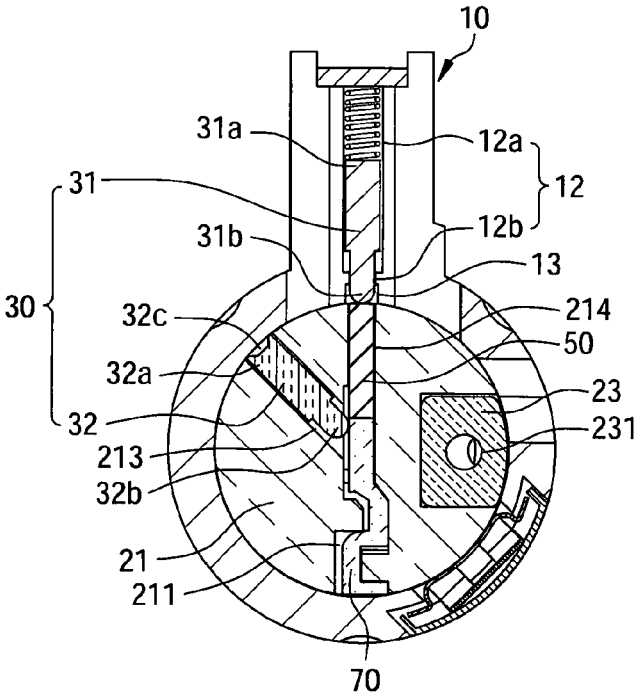
FIG. 5A is a longitudinal section view illustrating the first matched key is inserted into the rekeyable lock cylinder along A-A line of FIG. 2.
Figure 5B:
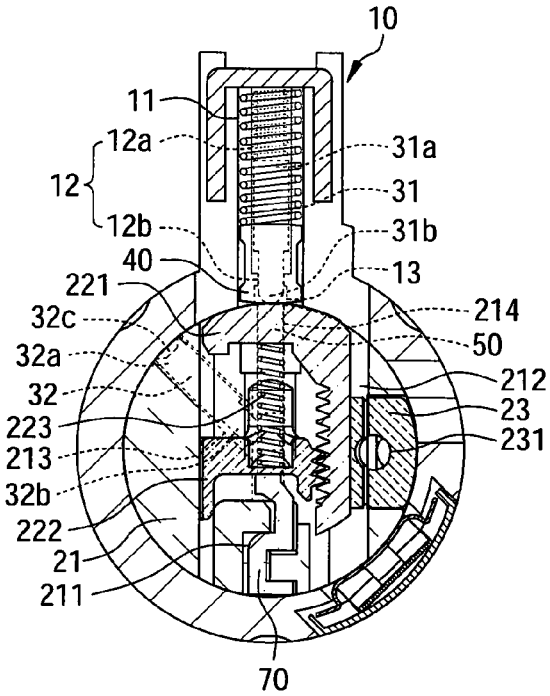
FIG. 5B is a longitudinal section view illustrating the first matched key is inserted into the rekeyable lock cylinder along B-B line of FIG. 2.
Figure 6A:
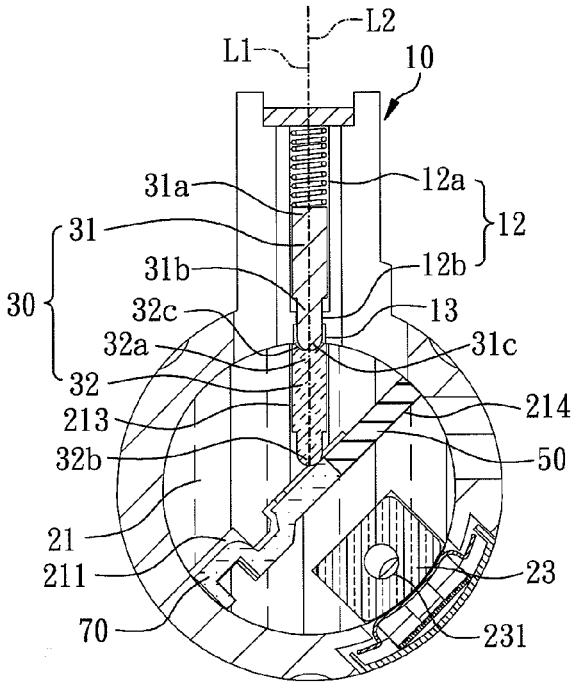
FIG. 6A is a longitudinal section view illustrating the first matched key is turned 45-degrees clockwise along A-A line of FIG. 2.
Figure 6B:
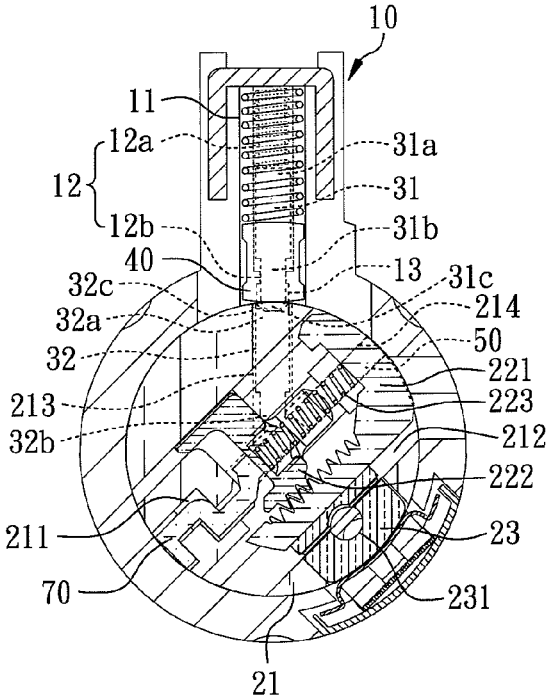
FIG. 6B is a longitudinal section view illustrating the first matched key is turned 45-degrees clockwise along B-B line of FIG. 2.
Figure 7A:
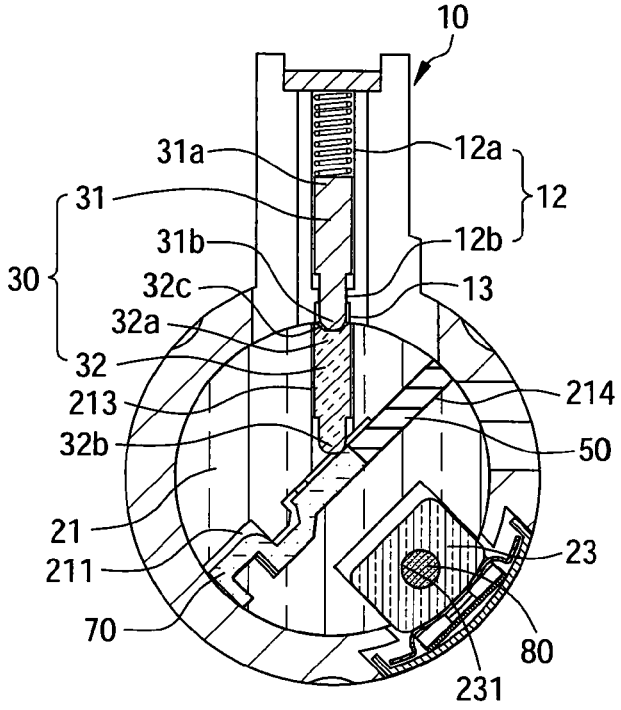
FIG. 7A is a longitudinal section view illustrating the rekeying tool is inserted into the rekeyable lock cylinder along A-A line of FIG. 2.
Figure 7B:
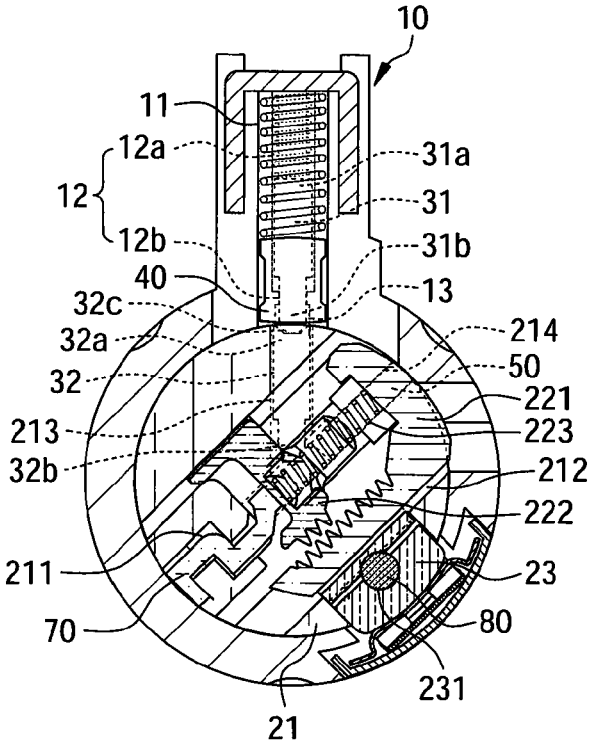
FIG. 7B is a longitudinal section view illustrating the rekeying tool is inserted into the rekeyable lock cylinder along B-B line of FIG. 2.
Figure 8A:
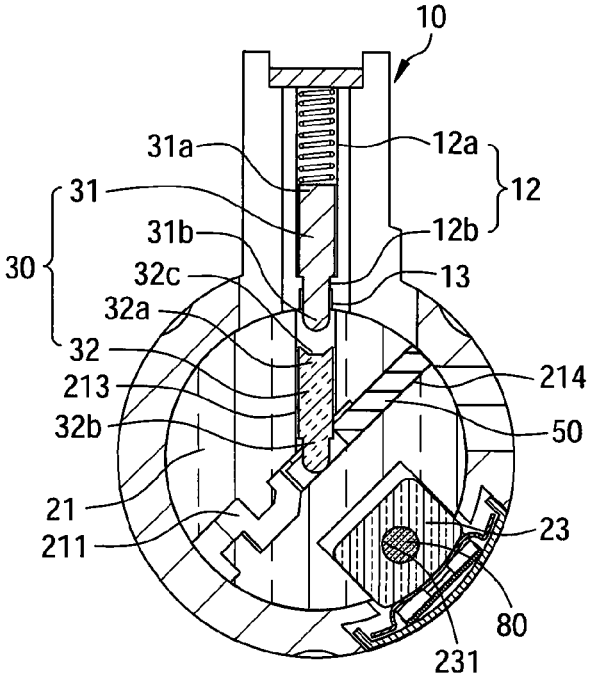
FIG. 8A is a longitudinal section view illustrating the first matched key is withdrawn along A-A line of FIG. 2.
Figure 8B:
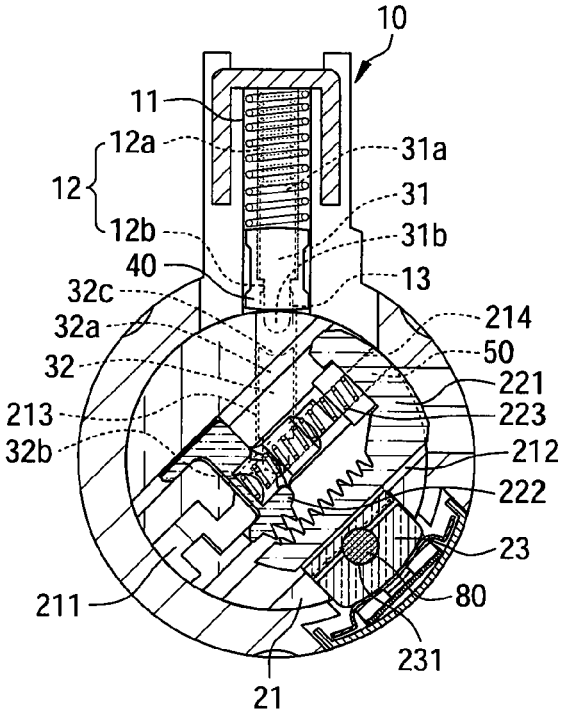
FIG. 8B is a longitudinal section view illustrating the first matched key is withdrawn along B-B line of FIG. 2.
Figure 9A:
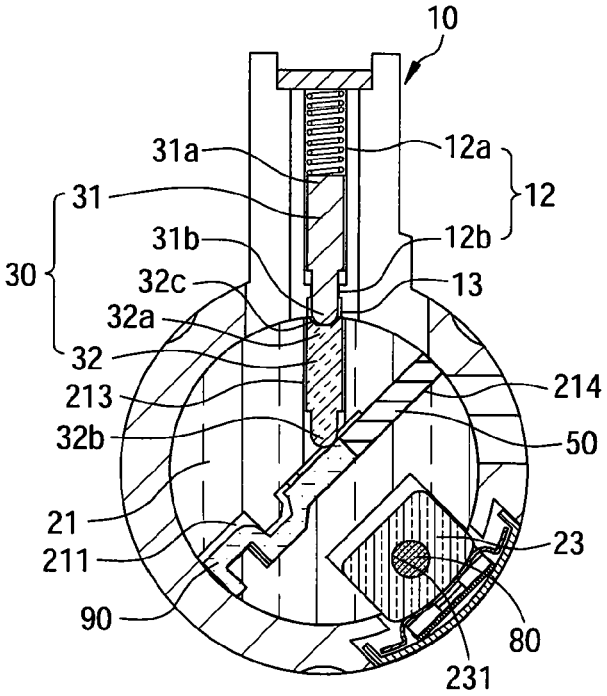
FIG. 9A is a longitudinal section view illustrating the second matched key is inserted into the position along A-A line of FIG. 2.
Figure 9B:
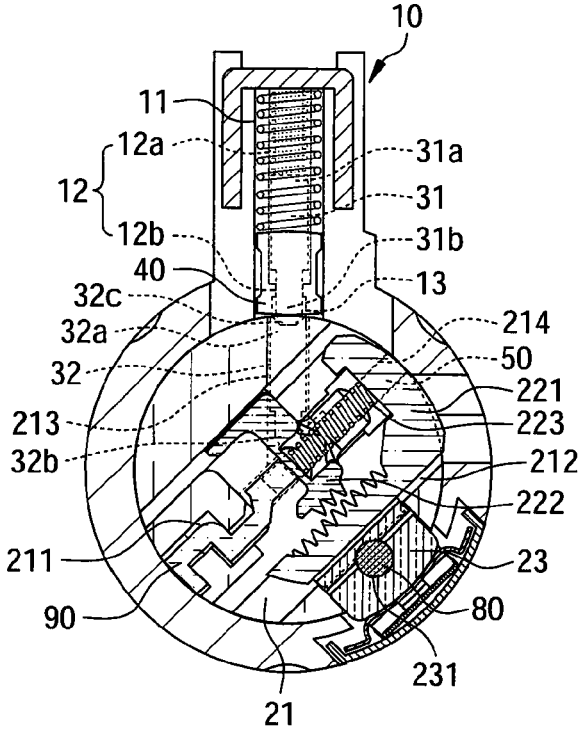
FIG. 9B is a longitudinal section view illustrating the second matched key is inserted into the position along B-B line of FIG. 2.
Figure 9C:
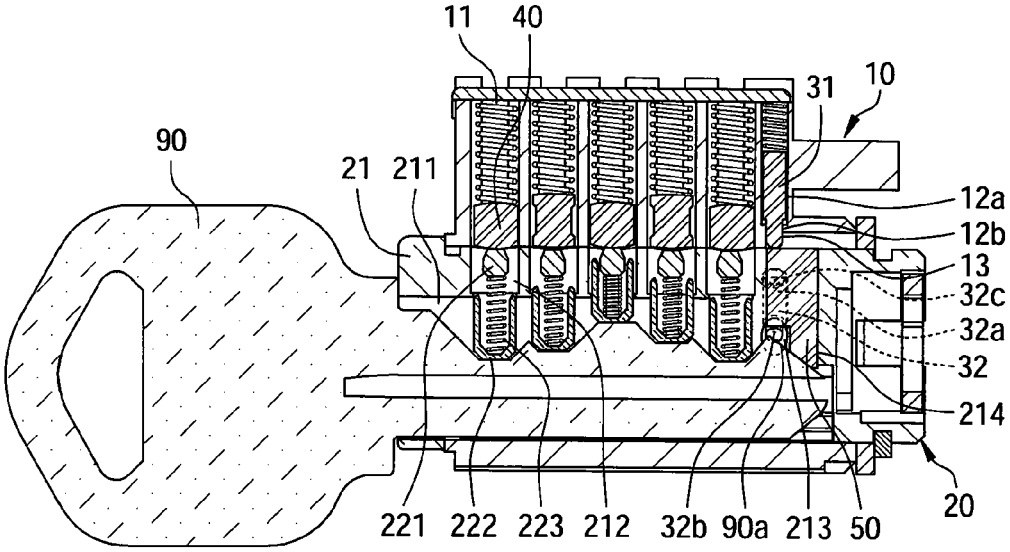
FIG. 9C is a longitudinal section view illustrating the second matched key is inserted into the position along C-C line of FIG. 2.
Figure 10A:
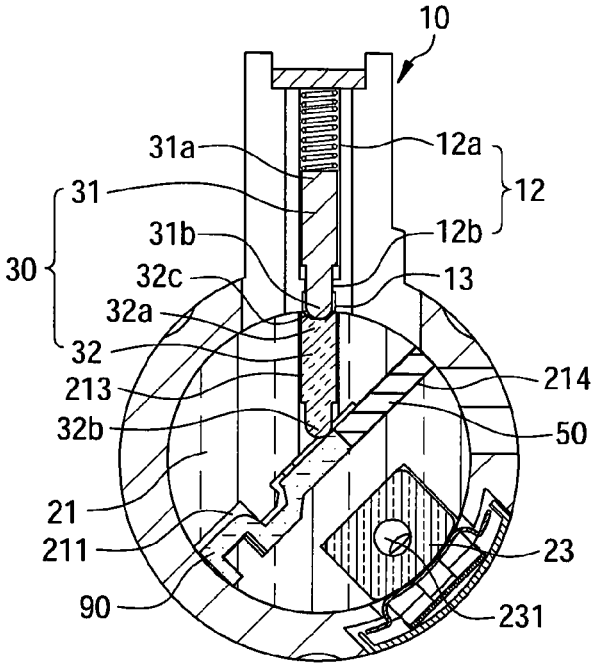
FIG. 10A is a longitudinal section view illustrating the rekeying tool is withdrawn along A-A line of FIG. 2.
Figure 10B:
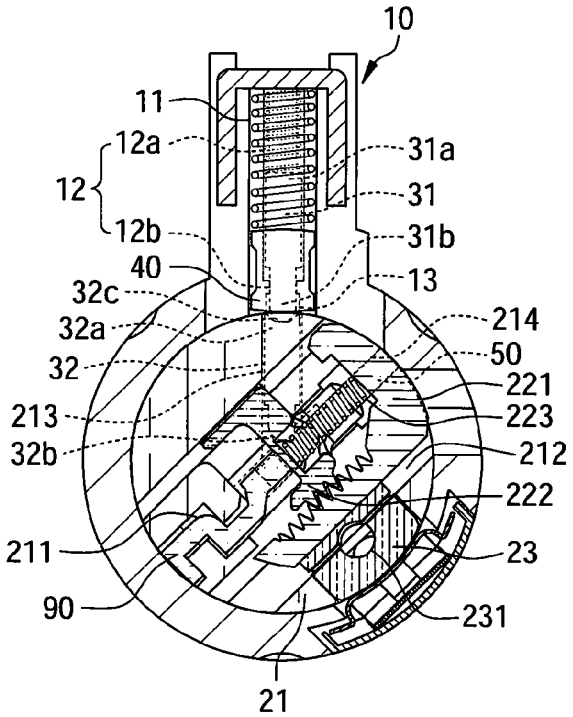
FIG. 10B is a longitudinal section view illustrating the rekeying tool is withdrawn along B-B line of FIG. 2.
Figure 11A:
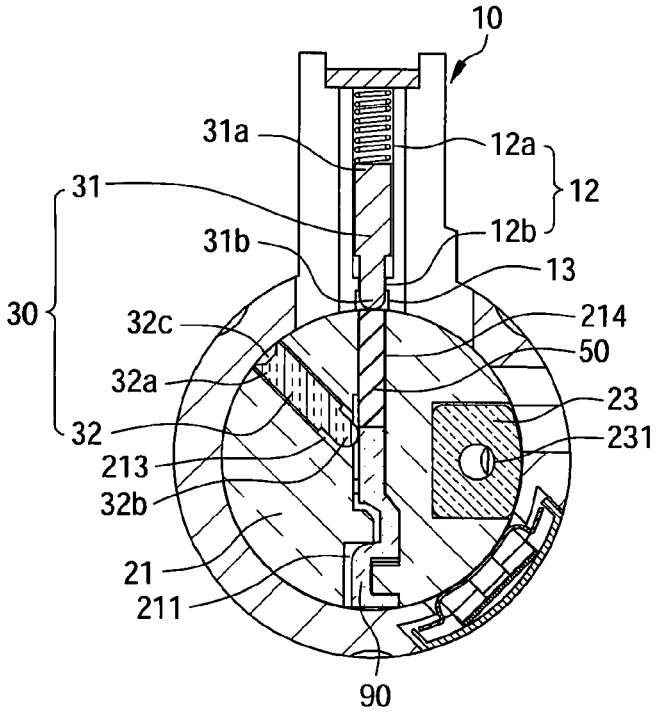
FIG. 11A is a longitudinal section view illustrating the rekeyable lock cylinder in normal service condition along A-A line of FIG. 2.
Figure 11B:
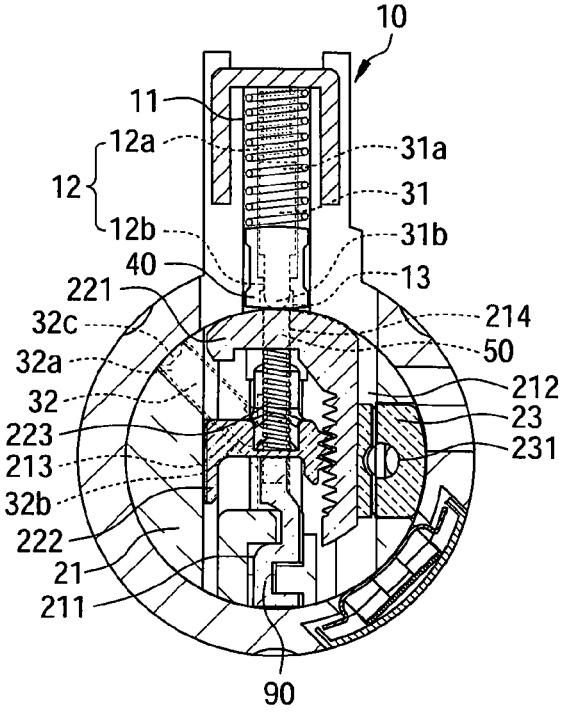
FIG. 11B is a longitudinal section view illustrating the rekeyable lock cylinder in normal service condition along B-B line of FIG. 2.
Figure 12A:
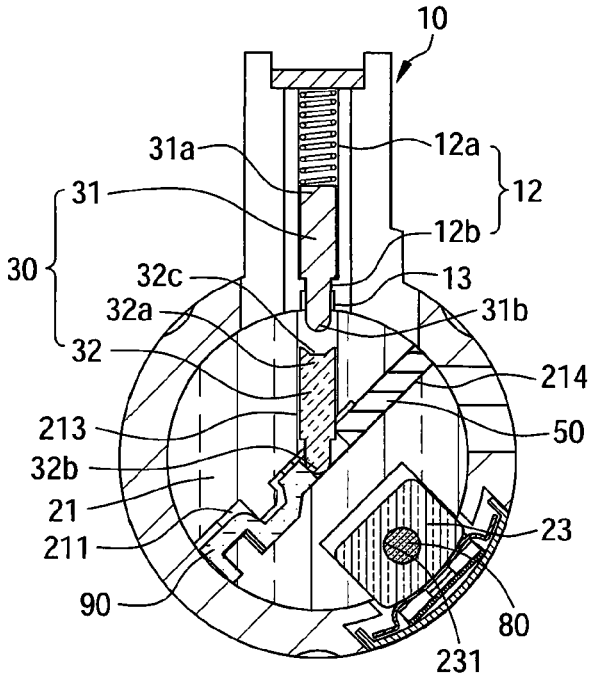
FIG. 12A is a longitudinal section view illustrating the second matched key isn't inserted into the position along A-A line of FIG. 2.
Figure 12B:
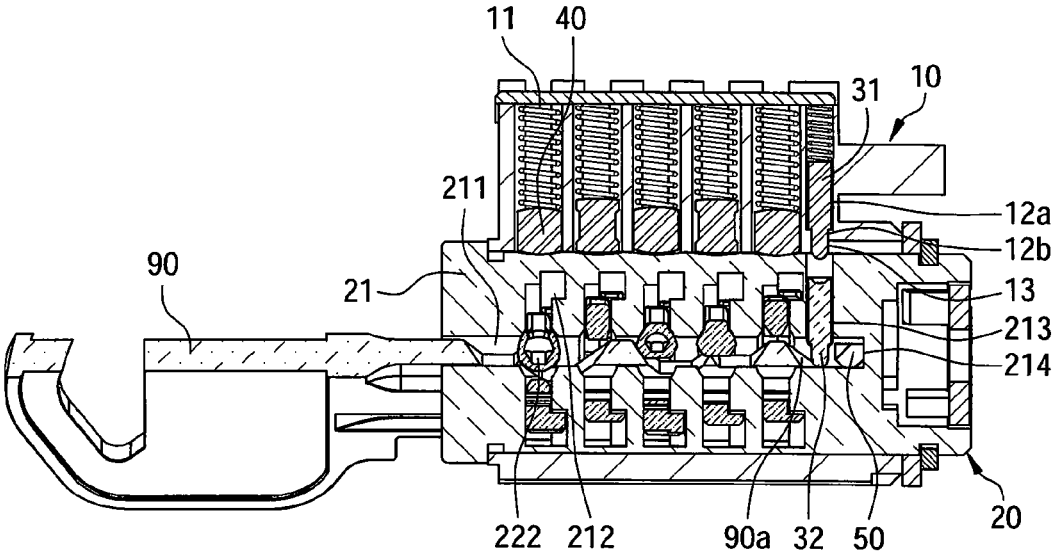
FIG. 12B is a longitudinal section view illustrating the second matched key isn't inserted into the position along C-C line of FIG. 2.

In addition, operation of the operation error preventing unit 30 according to the present invention will be described in detail as follows. First, with reference to FIGS. 5A and 5B, a matched key 70 is inserted into the keyhole 211 of the plug body 21 when rekeying. Next, with reference to FIGS. 6A and 6B, the first matched key 70 is turned to dive the plug body 21 and the position block 23 turning to a predetermined angular position (i.e. rekeyable position) where the first movable member 31 is aligned with the second movable member 32, in which the first matched key 70 is turned 45-degrees clockwise. Also, the offset line L2 is aligned with the axial line L1. Simultaneously, the end 31*c* of the first movable member 31 protrudes into the first hole 213 and contacts against the second movable member 32 so as to limit rotation of the plug assembly 20 opposite to the cylinder body 10. Within this step, the first side 32*a* of the second movable member 32 faces the first movable member 31 and the end 31*c* of the first movable member 31 should contact against the first side 32*a* in response of a rotation of the plug assembly 20, preferably the end 31*c* of the first movable member 31 contacts against the position slot 32*c* of the second movable member 32. Next, with reference to FIGS. 7A and 7B, a rekeying tool 80 is inserted to the rekeying tool opening 231 of the position block 23 to make the second rack components 222 release engagement with the first rack components 221. Next, with reference to FIGS. 8A and 8B, the first matched key 70 is withdrawn and meantime the second rack components 222 of the assembled rack components 22 and the second movable member 32 of the operation error preventing unit 30 fall down to lowermost position, and the lower rod portion 31*b* of the first movable member 31 will fall into the first hole 213 of the plug body 21 to limit the plug body 21 not to rotate. Next, with reference to FIGS. 9A, 9B and 9C, a second matched key 90 is inserted to the keyhole 211 of the plug body 21. When the second matched key 90 is pushed in at the position (i.e. completely pushed-in), the second rack components 222 of the assembled rack components 22 readjust height according to bitting of the second matched key 90 with different height. Besides, the second movable member 32 of the operation error preventing unit 30 is pushed by a pushing portion 90*a* of the second matched key 90 to go back to rotating interface. Within this embodiment, the pushing portion 90*a* of the second matched key 90 may selectively push the second movable member 32 and preferably is an inclined surface. Simultaneously, the first movable member 31 releases limitation of the plug body 21 to continue rekeying process. Contrarily, with reference to FIGS. 12A and 12B, when the second matched key 90 isn't inserted into the position (i.e. incompletely pushed-in), the pushing portion 90*a* of the second matched key 90 cannot push the second movable member 32 of the operation error preventing unit 30 back to rotating interface, meantime the plug body 21 will be limited by the first movable member 31 of the operation error preventing unit 30 unable to rotate, so rekeying process cannot continue. Next, with reference to FIGS. 10A and 10B, the rekeying tool 80 is withdrawn after the second matched key 90 is inserted into the position, which makes the second rack components 222 reengage with the first rack components 221. Finally, with reference to FIGS. 11A and 11B, the second matched key is turned to make lock cylinder restore normal service condition.

While this invention has been particularly illustrated and described in detail toward the preferred embodiments thereof, it will be clearly understood by those skilled in the art that is not limited to the specific features shown and described and various modified and changed in form and details may be made without departing from the spirit and scope of this invention.

What is claimed is:

1. A rekeyable lock cylinder comprising:

a cylinder body;

a plug assembly rotatable disposed within the cylinder body comprising:

a plug body having a longitudinal direction defined thereon, an outside wall, a keyhole formed along the longitudinal direction, a plurality of lower pin holes and a first hole in communication with the outside wall and the keyhole, and further the first hole is located adjacent to the longitudinal direction; and a plurality of assembled rack components disposed at each of the lower pin holes of the plug body respectively;

a first movable member having an end disposed at the cylinder body, wherein said first movable member is perpendicular to the longitudinal direction; and a second movable member disposed in the first hole of the plug body, wherein said second movable member is inclined at an angle to the first movable member when the lock cylinder is locked, the second movable member has a first side contacting against the end of the first movable member in response to a rotation of the plug assembly, and the end of the first movable member protrudes into the first hole of the plug body when the plug assembly turns to a rekeyable position where the first movable member is aligned with the second movable member so as to limit rotation of the plug assembly opposite to the cylinder body.

2. The rekeyable lock cylinder in accordance with claim 1, wherein the second movable member has a second side opposite to the first side and a position slot recessed at the first side, the end of the first movable member contacts against the position slot.

3. The rekeyable lock cylinder in accordance with claim 1, wherein the cylinder body has an accommodating hole, the accommodating hole has an upper slot portion and a lower slot portion, an inner diameter of the lower slot portion is smaller than that of the upper slot portion.

4. The rekeyable lock cylinder in accordance with claim 3, wherein the first movable member has an upper rod portion and a lower rod portion, the upper rod portion is located at the upper slot portion of the accommodating hole, a diameter of the upper rod portion is larger than that of the lower rod portion.

5. The rekeyable lock cylinder in accordance with claim 4, wherein the cylinder body has an inside wall and a limiting slot recessed from the inside wall, the limiting slot communicates with the lower slot portion of the accommodating hole.

6. The rekeyable lock cylinder in accordance with claim 5, wherein the lower rod portion of the first movable member is capable of being located at the lower slot portion of the accommodating hole and the limiting slot.

7. The rekeyable lock cylinder in accordance with claim 1, wherein the plug body further has a second hole in communication with the outside wall and the keyhole, there is an included angle between the second hole and the first hole.

8. The rekeyable lock cylinder in accordance with claim 7, wherein the plug assembly further comprising a burglarproof member disposed at the second hole of the plug body.

9. The rekeyable lock cylinder in accordance with claim 1, further comprising a matched key which has a pushing portion able to selectively push the second movable member.

10. The rekeyable lock cylinder in accordance with claim 9, wherein the pushing portion of the matched key is an inclined surface.

11. The rekeyable lock cylinder in accordance with claim 1, wherein the plug body further has a transverse direction defined thereon and perpendicular to the longitudinal direction, the first hole is formed along the transverse direction.

12. The rekeyable lock cylinder in accordance with claim 1, wherein the first movable member further has an axial line perpendicular to the longitudinal direction, and the second movable further has an offset line which is inclined at an angle to the axial line when the lock cylinder is locked, wherein the offset line is aligned with the axial line when the plug assembly turns to the rekeyable position.

13. A rekeyable lock cylinder comprising:

a cylinder body;

a plug assembly rotatable disposed within the cylinder body comprising:

a plug body having a longitudinal direction defined thereon; and a plurality of assembled rack components disposed at the plug body;

a first movable member disposed at the cylinder body, wherein said first movable member is perpendicular to the longitudinal direction;

a second movable member disposed in the plug body, wherein said second movable member is inclined at an angle to the first movable member when the lock cylinder is locked;

wherein the second movable member contacts against the first movable member in response to a rotation of the plug assembly; and the first movable member protrudes into the plug body when the plug body turns to a rekeyable position where the first movable member is aligned with the second movable member so as to limit rotation of the plug assembly opposite to the cylinder body.

14. The rekeyable lock cylinder in accordance with claim 13, wherein the cylinder body has an accommodating hole, the accommodating hole has an upper slot portion and a lower slot portion, an inner diameter of the lower slot portion is smaller than that of the upper slot portion.

15. The rekeyable lock cylinder in accordance with claim 14, wherein the first movable member has an upper rod portion and a lower rod portion, the upper rod portion is located at the upper slot portion of the accommodating hole, a diameter of the upper rod portion is larger than that of the lower rod portion.

16. The rekeyable lock cylinder in accordance with claim 15, wherein the cylinder body has an inside wall and a limiting slot recessed from the inside wall, the limiting slot communicates with the lower slot portion of the accommodating hole.

17. The rekeyable lock cylinder in accordance with claim 16, wherein the lower rod portion of the first movable member is capable of being located at the lower slot portion of the accommodating hole and the limiting slot.

* * * * *